US006425240B1

(12) United States Patent
Park

(10) Patent No.: US 6,425,240 B1
(45) Date of Patent: Jul. 30, 2002

(54) COMBUSTOR FOR GAS TURBINE ENGINE

(75) Inventor: Roger James Park, Lincoln (GB)

(73) Assignee: ABB Alstom Power UK Ltd., Lincoln (GB)

( * ) Notice: Subject to any disclaimer, the term of this patent is extended or adjusted under 35 U.S.C. 154(b) by 6 days.

(21) Appl. No.: 09/593,623

(22) Filed: Jun. 13, 2000

(30) Foreign Application Priority Data

Jun. 22, 1999 (GB) ..... 9914432

(51) Int. Cl.[7] ..... F02C 9/16
(52) U.S. Cl. ..... 60/39.23; 60/794
(58) Field of Search ..... 60/39.23, 39.27, 60/39.29, 794; 431/351, 352, 354, 355

(56) References Cited

U.S. PATENT DOCUMENTS

| | | | | |
|---|---|---|---|---|
| 2,837,893 A | | 6/1958 | Schirmer | |
| 3,577,878 A | | 5/1971 | Greenwood | |
| 3,859,787 A | | 1/1975 | Anderson et al. | |
| 3,919,838 A | * | 11/1975 | Armstrong et al. | 60/723 |
| 3,927,520 A | | 12/1975 | Arvin et al. | |
| 4,026,115 A | | 5/1977 | Melchior et al. | |
| 4,044,549 A | * | 8/1977 | Zwick | 60/39.23 |

FOREIGN PATENT DOCUMENTS

| | | |
|---|---|---|
| EP | 0 831 275 A2 | 3/1998 |
| GB | 1160709 | 8/1969 |

OTHER PUBLICATIONS

On–Engine Evaluation Of Emissions Characteristics Of a Variable Geometry Lean–Premixed Combustor, H, Yamada, et all, The American Society of Mechanical Engineers, pp. 1–5.

* cited by examiner

*Primary Examiner*—Louis J. Casaregola
(74) *Attorney, Agent, or Firm*—Kirschstein, et al.

(57) ABSTRACT

A gas turbine combustion includes a combustion chamber mounted within an air supply manifold. The combustion chamber preferably has a fixed downstream portion and a telescopically-movable upstream portion, a burner head provided with a fuel injector, and a primary air inlet from the manifold into the combustion chamber defined between the burner head and an upstream end of the telescopically-movable upstream portion. Movement of the upstream portion of the combustion chamber towards the burner head serves to restrict the primary air inlet while opening a secondary air inlet from the manifold into the combustion chamber downstream of the burner head. Movement of the upstream portion of the combustion chamber away from the burner head serves to open the primary air inlet while restricting the secondary air inlet.

20 Claims, 2 Drawing Sheets

COMBUSTOR FOR GAS TURBINE ENGINE

FIELD OF THE INVENTION

This invention relates to a variable geometry combustion for a gas turbine engine and to a gas turbine engine provided with such a combustion.

BACKGROUND TO THE INVENTION

Gas turbine engines in industrial applications are expected to operate over a range of varying load conditions rather than at some fixed optimum. It is also a requirement that certain minimum standards must be met in respect of environmental pollution from engine exhausts. In order to meet these demands, which are often in conflict, the combustion engineer is faced with substantial design difficulties. For example, in order to lower polluting NOx emissions, it is common to use so-called lean pre-mix systems which are effective during engine high load conditions. Unfortunately, such systems tend to increase polluting CO emissions at engine low load conditions (due to incomplete combustion at lower flame temperatures), and conventional methods of controlling CO emissions, such as air bleed systems, may result in loss of engine efficiency.

Attempts to overcome these difficulties include the use of what have become known as "variable geometry systems" (see ASME paper 95-GT-48 by Yamada, et al.), in which combustion system air (typically supplied from the engine compressor) is controlled so that, when an engine is being run at low load, proportionally less air is fed to the combustion chamber upstream fuel mixing region than is the case for higher loads. The balance of air required for the combustion system is diverted to a downstream region of the combustion chamber where it can do useful work in the gas stream. In this way the compressor and all compressor air is most effectively employed in contrast with other systems where the compressor output may be adjusted to give less flow, or where some of the compressed air is vented off (both such schemes usually being less efficient). Such a variable air distribution system allows flame temperatures to be held reasonably constant at the optimum design higher load level (higher temperature) and consequently pollution emission levels may be held to a minimum.

Mechanisms for controlling air distribution in "variable geometry systems" usually consist of connected valve means acting in unison to divert compressor air proportionally to upstream and downstream regions of a combustion chamber, the combustion chamber being fixed in position relative to the engine main casing, as can be seen, for example, in U.S. Pat. No. 3,859,787 to Anderson, et al.

On the other hand, U.K. Patent No. GB 1,160,709 to Lucas discloses an annular combustion comprising a combustion chamber or flame tube which is bodily movable axially within an air jacket casing or manifold. There are inlets for primary and secondary air in upstream and downstream regions of the flame tube, referred to the direction of flow of combustion products through the flame tube. Movement of the flame tube is towards or away from the upstream end of the combustion, an inlet for primary combustion air being defined between a fixed burner head and the upstream end of the movable flame tube. Hence, movement of the flame tube relative to the burner head varies the size of the primary inlet, but there is no provision for varying the size of the secondary inlet.

OBJECT OF THE INVENTION

An object of the present invention is to provide a relatively simple, inexpensive, convenient and easily controlled way of metering primary and secondary flows of air into the upstream and downstream regions of a combustion chamber simultaneously and in proportions which facilitate efficient combustion at high- and low-load conditions of the engine.

SUMMARY OF THE INVENTION

The invention can achieve the above object by linear movement of a combustion component.

According to the invention, a gas turbine combustor comprises a combustion chamber mounted within an air supply manifold. The combustion chamber has a burner head provided with a fuel injector means; a primary air inlet from the manifold into the combustion chamber, the primary air inlet being defined between the burner head and an upstream end of the combustion chamber; a secondary air inlet from the manifold into the combustion chamber downstream of the primary air inlet; and means for varying air flow through the primary and secondary air inlets.

More particularly, the combustion chamber comprises first and second portions telescopically movable relative to each other, the secondary air inlet from the manifold into the combustion chamber being defined between the first and second portions of the combustion chamber, the first and second portions of the combustion chamber being relatively movable in a first axial sense to increase air flow through the primary air inlet and reduce air flow through the secondary air inlet, and in a second and opposite axial sense to reduce air flow through the primary air inlet and increase air flow through the secondary air inlet.

It is simplest and most convenient if the first and second portions of the combustion chamber are relatively axially movable so as to vary the air flows through the primary and secondary air inlets in inverse proportion to each other. Preferably, when the air flow through the primary air inlet is at a maximum, the secondary air inlet is fully closed; and when the air flow through the primary air inlet is at a minimum, the secondary air inlet is fully open.

The secondary air inlet may be defined through a wall of the first portion of the combustion chamber. Alternatively, it may be defined through a wall of the second portion of the combustion chamber. As a further alternative, it may be defined through both said walls, e.g., by apertures in both walls moving into or out of registration with each other during relative telescopic movement of the first and second portions of the combustion chamber.

Preferably, the first and second portions of the combustion chamber are respectively movable and fixed with respect to fixed structure of the combustor. Thus, the first (movable) portion of the combustion chamber may be slidable either inside of, or over the outside of, the second (fixed) portion, the movable portion extending upstream such that the primary air inlet is defined between the burner head and an upstream end of the movable portion. Preferably, the first and second portions of the combustion chamber are respectively upstream and downstream portions of the combustion chamber, having only a relatively small mutual overlap sufficient to accommodate the secondary air inlets. Alternatively, but only in the case where the first (movable) portion of the combustion chamber is slidable over the outside of the second (fixed) portion of the combustion chamber, the first and second portions of the combustion chamber overlap over the whole length of the second portion.

Preferably, axial movements in said first and second senses are respectively movements towards and away from the burner head.

An annular seal, such as a piston-ring type seal, is preferably located between the first and the second portions of the combustion chamber to facilitate relative telescopic sliding movement between them.

Conveniently, the telescopic sliding movement may be achieved by connecting the movable portion of the combustion chamber to actuator means for pushing and pulling the movable portion in the first and second axial senses.

The invention further comprises a gas turbine engine provided with at least one gas turbine combustor as described above. In particular, such a gas turbine engine may be provided with at least one combustor in which the actuator is arranged to move the movable portion of the combustion chamber towards the burner head as the engine load decreases, and to move the movable portion of the combustion chamber away from the burner head as the engine load increases.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

Exemplary embodiments of the invention will now be described with reference to the accompanying drawings, which are not to scale.

DETAILED DESCRIPTION OF THE PREFERRED EMBODIMENTS

Figure 1:
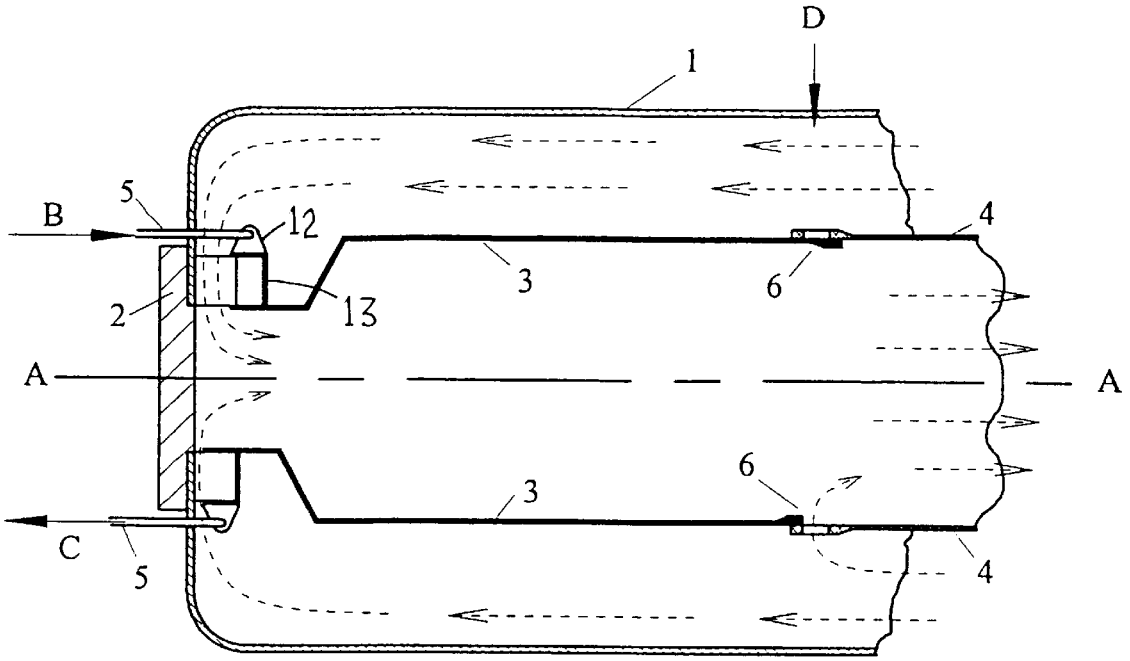
FIG. 1 is a longitudinal section through part of a gas turbine combustor; the portion of FIG. 1 above the combustor's longitudinal centerline or axis A—A illustrates the configuration of the combustor to operate a gas turbine engine at high load, while the portion below the axis A—A illustrates the combustor configuration to operate the gas turbine engine at low load.

In operation, air is supplied from an engine-driven compressor (not shown), through an air supply manifold 1 which supports a burner head 2. The combustion chamber comprises first and second portions 3, 4 (i.e., left- and right-hand portions, or upstream and downstream portions relative to the direction of flow of combustion products through the combustor) and is mounted co-axially within the air supply manifold 1. It receives the compressor output as indicated by the dotted arrows, which are directed to the left and then pass across the burner head 2 into the upstream end of the left hand combustion chamber portion 3. The right hand combustion chamber portion 4 is fixed relative to the manifold 1 and burner head 2 and constitutes the downstream portion of the combustion chamber leading to a transition duct (not shown) for guiding the combustion gases to a turbine (not shown) which extracts energy from the gases.

The upstream combustion chamber portion 3 is movable relative to the manifold 1 and burner head 2 and its right hand end is a close sliding fit within the fixed downstream combustion chamber portion 4 as shown. In this manner, the upstream combustion chamber portion 3 is telescopically movable along the axis A—A, such movement being effected by actuator rods 5 attached to brackets 12 fixed to flanges 13 of the combustion chamber portion 3. By pushing the actuator rods 5 in a first (downstream) axial sense, shown by the direction of arrow B, the upstream combustion chamber portion 3 is moved to the right as shown in the upper portion of FIG. 1. Pulling the actuator rods 5 in a second and opposite (upstream) axial sense, shown by the direction of arrow C, moves the upstream combustion chamber portion 3 to the left, as indicated in the lower portion of FIG. 1. This telescopic movement controls a secondary air bypass valve arrangement 6 which will be described later in more detail with reference to FIGS. 3 and 3*a*. Although two actuator rods 5 per movable combustion chamber portion 3 are shown in FIG. 1, it would be possible to use only one actuator rod per combustion chamber portion.

Figure 2:
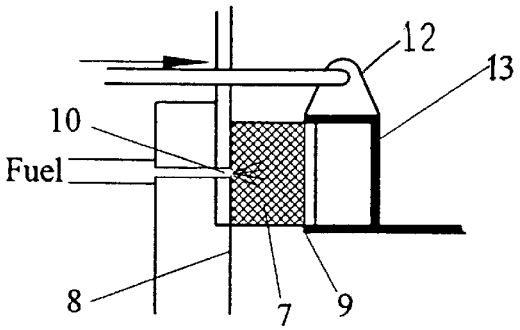
FIG. 2 is an enlarged scrap section of part of FIG. 1 showing the burner head with the primary air inlet fully open to operate a gas turbine engine at high load.
Figure 2A:
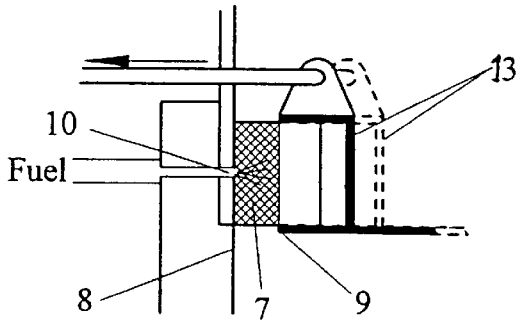
FIG. 2*a* is a scrap section similar to FIG. 2 but showing the primary air inlet partially closed to operate a gas turbine engine at low load, dotted lines indicating the high load position.

Air required for primary combustion enters the upstream combustion chamber portion 3 through a burner passage defined between a face 8 of the burner head and a lip 9 of the upstream end of the movable combustion chamber portion 3, as illustrated in FIGS. 2 and 2*a*. In these Figs. the relative size of the burner passage 7 is emphasized by cross-hatching. As the primary combustion air passes through the passage 7, it mixes with fuel from injectors 10 and the air-fuel mixture is initially ignited within the combustion chamber 3, 4 by a spark from an igniter unit (not shown) which may be situated in any convenient location, as is well known in the art. Combustion takes place primarily in the upstream combustion chamber portion 3, and the hot combustion products (as a working fluid) proceed in the direction of the dotted arrows from left to right, through the downstream combustion chamber portion 4 to the engine turbine (not shown).

It will be seen from FIG. 1 that when the actuator rods 5 move the combustor wall portion 3 to an extreme limit of movement in the direction of arrow B, all the compressor air is routed through the burner passage 7 for primary combustion. In this position the burner passage 7 has maximum cross-sectional area with the minimum restriction to air flow (see cross-hatched area of FIG. 2), the air bypass valve arrangement 6 being fully closed so that no air can pass through it. This configuration corresponds with the engine maximum load condition. Conversely, when the actuator rods 5 move the combustor wall portion 3 to an extreme limit of movement in the direction of arrow C, the cross-sectional area of the burner passage 7 is reduced to a minimum (see cross-hatched area of FIG. 2*a*), so that the primary air flow passing through the burner passage 7 is limited, the remaining air passing through the fully open ports of the air bypass valve arrangement 6. This configuration relates to engine low-load condition.

It will be appreciated that, by controlling the actuator rods 5, the combustion chamber 3, 4 may be set to any position between those illustrated in FIGS. 2 and 2*a* so that it is possible to maintain the correct primary to secondary air ratio to ensure acceptable exhaust pollution and engine efficiency standards for various load conditions. It will be understood that by this simple and convenient arrangement, the primary and secondary air flows are varied in inverse proportion to each other.

Figure 3:
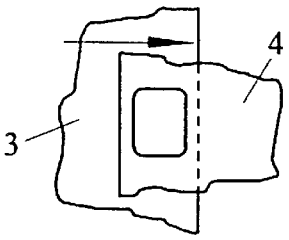
FIG. 3 is an enlarged scrap elevation, taken in the direction of arrow "D" in FIG. 1, and showing a bypass valve porting arrangement for the secondary air inlet in its closed position for operating the gas turbine engine at high load.
Figure 3A:
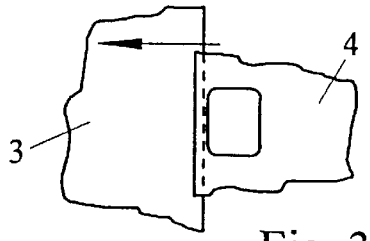
FIG. 3*a* is an enlarged scrap view similar to FIG. 3 but showing the bypass valve porting arrangement for the secondary air inlet in its fully open position for operating the gas turbine engine at low load.
Figure 5:
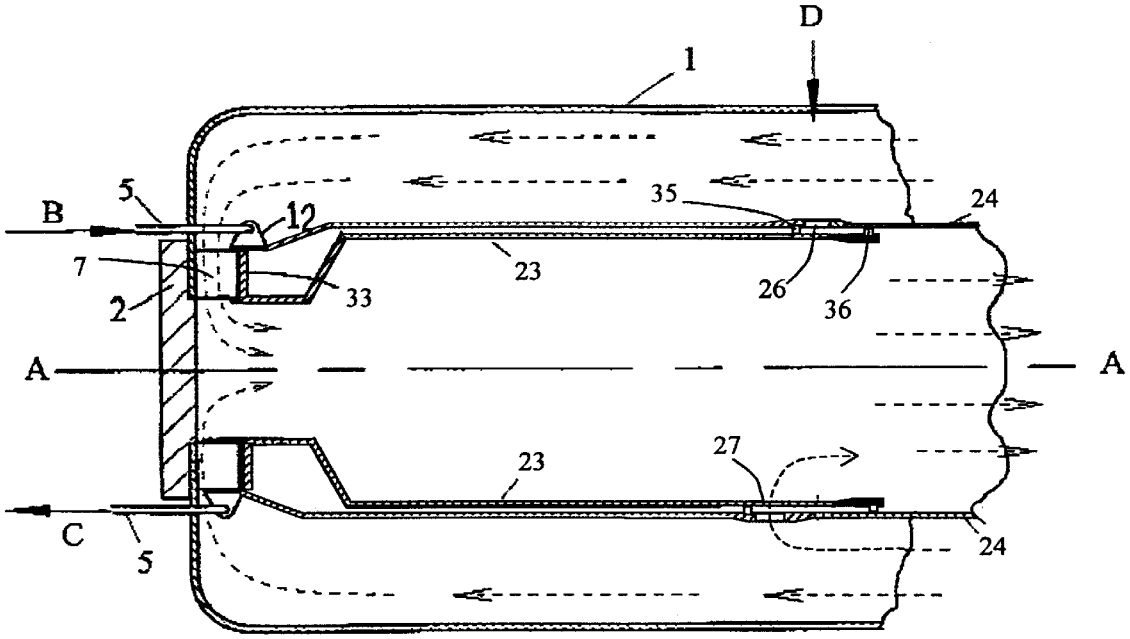
FIG. 5 is a view similar to FIG. 1, but illustrating a further embodiment of the invention.
Figure 5A:
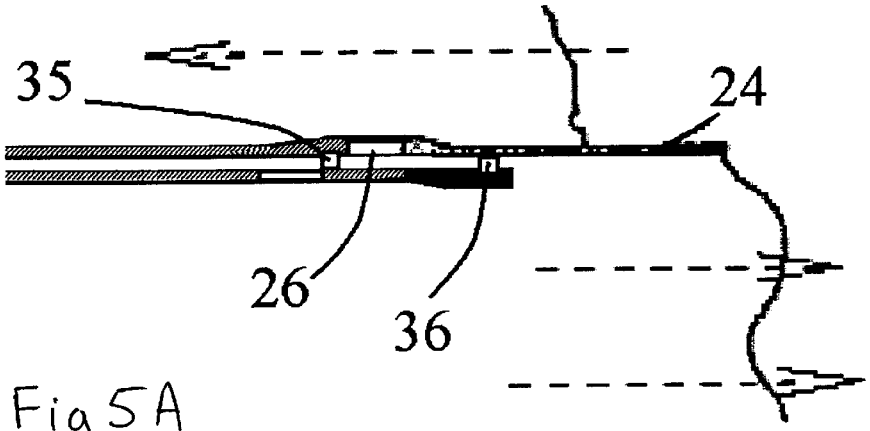
FIGS. 5A and 5B are enlargements of portions of FIG. 5 showing upper and lower secondary air inlets in the closed and open positions, respectively.
Figure 5B:
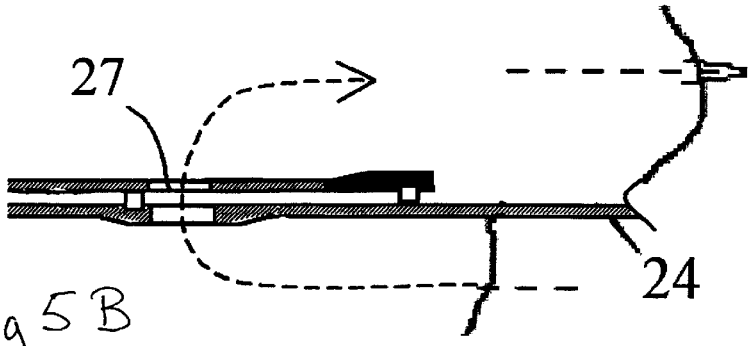

FIGS. 3 and 3*a* illustrate the manner in which a port defined through a wall of the downstream combustion chamber portion 4 can be closed by the so-called "skirt" at the downstream end of the movable combustion chamber portion 3 when the primary air inlet 7 is fully open, but can be opened by movement of the combustion chamber portion 3 towards the burner head 2. Although only one port is illustrated in FIGS. 3 and 3*a*, it will be noted that two ports are illustrated in FIG. 1, and the number and cross-sectional area of the ports can be varied to provide whatever secondary air flow is suitable for low load conditions. It will be appreciated that the port or ports could alternatively be provided in the movable combustion chamber portion, to be occluded by the upstream end of the fixed wall portion. As a further alternative, the secondary air inlet may be defined by apertures provided in both the fixed 4 and movable 3 portions of the combustion chamber. Such an arrangement is illustrated in FIG. 5, as further described below. Such apertures would meter the flow by moving into or out of registration with each other during relative telescopic movement of the upstream and downstream portions of the combustion chamber.

Figure 4:
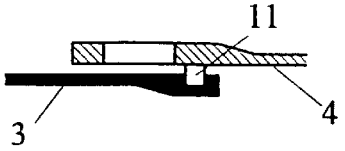
FIG. 4 is a longitudinal section through the bypass valve porting arrangement of FIG. 3.

Although in FIGS. 1 and 4, the downstream end of the movable wall portion 3 is shown nested inside the upstream end of the fixed wall portion 4, it will be realized that an equivalent arrangement would be to nest the upstream end of the fixed wall portion 4 inside the downstream end of the movable wall portion 3.

In FIG. 4 it will be noted that a piston ring type seal 11 is located in a groove in the upstream combustion chamber portion 3 so that an efficient sliding seal is provided between the combustion chamber portions 3 and 4, thereby reducing sliding friction while at the same time maintaining concentric alignment with respect to the longitudinal centerline A—A.

In the preferred specific embodiments of the invention illustrated in FIGS. 1 to 4, the upstream, radially inner portion 3 of the combustion chamber is slidable inside of the upstream end of the fixed downstream, radially outer portion 4. However, it is conceivable that a radially outer portion of the combustion chamber could be the movable portion and a radially inner portion 3 could be the fixed portion. For example, in FIG. 5, the downstream, radially outer portion 24 is extended to the left so that it surrounds the upstream, radially inner portion 23, thereby producing a double-walled combustion chamber over this axial length, and the actuators 5 are attached to brackets 12 fixed to the outside of the leftward-extended portion 24 of the combustion chamber.

The fixed inner combustor wall portion 23 has an outwardly turned flange 33 at its upstream end which is connected to the air manifold 1 through vanes which define passages comprising the primary air inlet 7. With a fixed inner combustor wall portion 23, metering of the airflow through the primary air inlet 7 can be achieved by movement of the upstream lip of the outer leftward-extended wall portion 24 back and forth over the outer perimeter of the air inlet 7.

The arrangement for the secondary air inlet 26 is somewhat different to that shown in FIG. 1, the secondary air inlet being defined by apertures provided in both the fixed 23 and movable 24 portions of the combustion chamber. This requires two piston ring seals 35 and 36 to seal between the fixed and movable portions 23 and 24. Seal 35 is seated in a groove in the inside of movable wall portion 24 and seal 36 is seated in a groove in the outside of fixed wall portion 23.

When the primary air inlet is fully open, as shown in the top half of FIG. 5, air cannot flow into the combustion chamber through inlets 26 in the movable wall portion 24, because seal 35 prevents flow through the corresponding inlets 27 in the fixed wall portion 23 and seal 36 prevents flow through the gap between the downstream end of the fixed wall portion 23 and the movable wall portion 24.

When the primary air inlet is at its most restricted, as shown in the bottom half of FIG. 5, seal 36 still prevents flow through the gap between the downstream end of the fixed wall portion 23 and the movable wall portion 24, but seal 35 has moved with the movable wall portion 24 to a position just upstream of inlets 27 in the fixed wall portion 23, so that secondary air can flow into the combustion chamber through inlets 26 and 27. Though feasible, the alternative arrangement of FIG. 5 is not preferred because of the extra weight and expense of the leftward-extended combustor portion 24, the need for two seals 35 and 36, and the need for a further sliding joint (not shown) in a highly stressed downstream part of the combustion chamber wall to accommodate relative movement between the movable wall portion 24 and the turbine.

It will be understood that each of the elements described above, or two or more together, also may find a useful application in other types of constructions differing from the types described above.

While the invention has been illustrated and described as embodied in a combustor for a gas turbine engine, is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

I claim:

1. A gas turbine combustor, comprising:

a) a combustion chamber having first and second, hollow, chamber portions at least partly overlapping each other and being mounted for telescoping movement relative to each other along an axis between end-limiting positions;

b) an air supply manifold having primary and secondary air inlets spaced apart along the axis and being together operative for supplying air to the combustion chamber, the primary inlet having a variable cross-sectional area through which a primary part of the air flows into the combustion chamber, the secondary inlet being located at an overlapping region of the chamber portions and having a variable cross-sectional area through which a secondary part of the air flows into the combustion chamber;

c) a fuel injector for injecting fuel to the primary part of the air flowing into the combustion chamber;

d) a burner for combustion the fuel and the air within the combustion chamber; and e) an actuator means for moving the chamber portions relative to each other in opposite directions along the axis between the end-limiting positions, and for varying the cross-sectional areas of the primary and secondary inlets in inverse proportion to each other during movement of the chamber portions.

2. The gas turbine combustor according to claim 1, in which each chamber portion has an annular chamber wall concentric with the axis.

3. The gas turbine combustor according to claim 1, in which the combustion chamber is mounted within the manifold.

4. The gas turbine combustor according to claim 1, in which the actuator means varies the cross-sectional area of the primary inlet to be at a maximum, and the cross-sectional area of the secondary inlet to be at a minimum, in one of the end-limiting positions.

5. The gas turbine combustor according to claim 1, in which the actuator means varies the cross-sectional area of the primary inlet to be at a minimum, and the cross-sectional area of the secondary inlet to be at a maximum, in one of the end-limiting positions.

6. The gas turbine combustor according to claim 1, in which the actuator means is operative for moving one of the chamber portions, and in which said one of the chamber portions has a boundary wall that bounds the primary inlet and that jointly moves with said one of the chamber portions to vary the cross-sectional area of the primary inlet.

7. The gas turbine combustor according to claim 6, in which the actuator means includes a rod extending parallel to the axis, and operatively connected to the boundary wall.

8. The gas turbine combustor according to claim 6, wherein said one of the chamber portions has a lip extending parallel to the axis.

9. The gas turbine combustor according to claim 1, in which the secondary inlet has an aperture extending through one of the chamber portions at the overlapping region.

10. The gas turbine combustor according to claim 1, in which the secondary inlet has an aperture extending through each of the chamber portions at the overlapping region.

11. The gas turbine combustor according to claim 1, and further comprising a seal in sealing engagement between the chamber portions at the overlapping region.

12. The gas turbine combustor according to claim 1, and further comprising a pair of seals spaced apart along the axis, each seal being in sealing engagement between the chamber portions at the overlapping region.

13. The gas turbine combustor according to claim 1, in which the actuator means is operative for moving one of the chamber portions, and in which the other of the chamber portions is fixed to the manifold.

14. The gas turbine combustor according to claim 13, in which said one chamber portion is slidably mounted inside said other chamber portion.

15. The gas turbine combustor according to claim 13, in which said one chamber portion is slidably mounted outside said other chamber portion.

16. The gas turbine combustor according to claim 1, in which the first chamber portion receives the fuel and the primary part of the air for combustion, and wherein the second chamber portion,receives the secondary part of the air.

17. The gas turbine combustor according to claim 1, in which one of the chamber portions overlies an entire length of the other of the chamber portions.

18. A gas turbine engine operative between a maximum load condition and a low-load condition, comprising: a gas turbine combustor, including:

a) a combustion chamber having first and second, hollow, chamber portions at least partly overlapping each other and being mounted for telescoping movement relative to each other along an axis between end-limiting positions corresponding to the maximum load and no-load conditions;

b) an air supply manifold having primary and secondary air inlets spaced apart along the axis and being together operative for supplying air to the combustion chamber, the primary inlet having a variable cross-sectional area through which a primary part of the air flows into the combustion chamber, the secondary inlet being located at an overlapping region of the chamber portions and having a variable cross-sectional area through which a secondary part of the air flows into the combustion chamber;

c) a fuel injector for injecting fuel to the primary part of the air flowing into the combustion chamber;

d) a burner for combustion the fuel and the air within the combustion chamber; and e) an actuator means for moving the chamber portions relative to each other in opposite directions along the axis between the end-limiting positions, and for varying the cross-sectional areas of the primary and secondary inlets in inverse proportion to each other during movement of the chamber portions.

19. The engine according to claim 18, in which the actuator means is operative for moving one of the chamber portions, and in which the other of the chamber portions is fixed relative to the manifold, and in which the actuator means includes at least one rod parallel to the axis and operatively connected to said one chamber portion to move the latter toward the burner as the engine load decreases toward the low-load condition, and away from the burner as the engine load increases toward the maximum load condition.

20. The engine according to claim 19, in which said one chamber portion has a lip extending parallel to the axis and jointly movable with said one chamber portion.

* * * * *